United States Patent [19]

Chaplin et al.

[11] Patent Number: 4,978,320

[45] Date of Patent: Dec. 18, 1990

[54] SURFACE EFFECT SHIP ENGINE MOUNT SYSTEM

[75] Inventors: John B. Chaplin, Covington; Robert G. Moore; John M. Ryken, both of Slidell, all of La.

[73] Assignee: Textron Inc., Providence, R.I.

[21] Appl. No.: 522,499

[22] Filed: Aug. 3, 1988

Related U.S. Application Data

[63] Continuation of Ser. No. 055,468, May 28, 1987, abandoned.

[51] Int. Cl.[5] ..... B63H 21/30

[52] U.S. Cl. ..... 440/052; 188/377; 248/562; 248/573; 440/111

[58] Field of Search ..... 440/52, 111, 112; 267/166, 167; 248/570, 628, 638, 562, 573; 188/376, 377

[56] References Cited

U.S. PATENT DOCUMENTS

| | | | |
|---|---|---|---|
| 2,022,652 | 12/1935 | Fahrney et al. | 440/112 |
| 2,046,558 | 7/1936 | Hussman | 440/111 |
| 2,359,000 | 9/1944 | Rosenzweig | 248/562 |
| 2,595,863 | 5/1952 | Loofbourrow | 440/112 |
| 2,867,405 | 1/1959 | Curriston | 248/638 |
| 3,030,056 | 4/1962 | Rogers | 248/638 |
| 3,057,320 | 10/1962 | Daniels | 440/112 |
| 3,143,321 | 8/1964 | McGehee et al. | 188/376 |
| 3,204,911 | 9/1965 | Lawrence et al. | 248/358 |
| 3,298,465 | 1/1967 | Stastny | 188/377 |
| 3,459,395 | 8/1969 | Scotto | 248/562 |
| 4,190,227 | 2/1980 | Belfield et al. | 248/636 |
| 4,293,304 | 10/1981 | Sandstrom | 440/52 |
| 4,584,928 | 4/1986 | Haynes | 92/161 |
| 4,605,106 | 8/1986 | Fyfe et al. | 188/377 |
| 4,619,349 | 10/1986 | Braun | 188/380 |

FOREIGN PATENT DOCUMENTS

| | | | |
|---|---|---|---|
| 2251432 | 5/1973 | Fed. Rep. of Germany | 440/111 |
| 17040 | 1/1984 | Japan | 267/166 |
| 741003 | 6/1980 | U.S.S.R. | 267/167 |

*Primary Examiner*—Sherman Basinger
*Assistant Examiner*—Thomas J. Brahan
*Attorney, Agent, or Firm*—Bean, Kauffman & Spencer

[57] ABSTRACT

There is disclosed a marine vessel which is particularly suited for mine hunting operations or the like because of improved survivability characteristics in the presence of multi-directed underwater transmitted excessive shock or vibration forces, such as are generated by a nearby exploding mine or the like. The ship is of the propeller driven type having a propeller shaft driving engine and gearbox unit mounted inboard of the vessel hull upon a rigid sled-like platform which in turn is resiliently supported relative to rigid structure of the vessel by spring means sandwiched therebetween. The spring means are of such nature as to resiliently yield in response to excessive compression, tension, shear or roll forces encountered from any direction. The spring means comprises an array of spaced apart spring devices, and back-up blocks of non-resilient compression-deformable material are provided in association therewith.

18 Claims, 3 Drawing Sheets

Fig. 6.

SURFACE EFFECT SHIP ENGINE MOUNT SYSTEM

BACKGROUND AND OBJECTS OF THE INVENTION

This is a continuation of co-pending application Ser. No. 055,468 filed on May 28, 1987, abandoned.

This invention relates to internal combustion type power plant engine mounting arrangements in marine vessels, and more particularly, the invention relates to the mountings of ship propeller driving engine/gearbox arrangements in SES (surface effect ship) vessels of the laminated glass fibre hull types or the like. SES type vessels are especially adapted for use in submarine hunting and mine hunting and neutralizing operations, and for such purposes are uniquely superior to monohull type vessels because when operating "on-cushion" most of the weight of the ship is supported by an air cushion confined under the main hull which thereupon rides clear of the water while only the keels of the side hulls are slightly submerged. Hence, the total ship structure/-water interface contact area is markedly fractional compared to that in the case of a monohull ship, and the effects of hammer-like shock waves such as are caused by environmentally encountered mine explosion shocks or the like upon an SES type ship and the personnel thereof are minimal and ship survivability prospects are optimized. For optimum operating efficiencies, the overall gross weight is of utmost importance, and for that reason it is preferable to employ polymer laminated glass fibre materials in the hull construction, and the like. Nevertheless, such vessels do on occasion become subjected to violent underwater conveyed shocks such as are caused by closely nearby exploding mines or the like.

The continued operational and survivability prospects of the ship depend to large extent upon the competence of the ship's hull, and also upon the abilities of the ship's engine fuel supply and control lines to remain intact and fully operative despite in such case the tendencies of the heavier components within the ship's construction (such as the propeller driving engines or the like) to lunge in various directions relative to their mounting devices in the hull.

It was therefore the object of the present invention to provide in a ship as above referred to, an impact shock resistant and absorbing arrangement comprising improved means for mounting therein the relatively heavy operational components of the ship's assembly such as the primary power supply diesel type engines or the like. This is accomplished in accord with the invention in such manner as to provide for the hull structure of the ship as well as for the interconnected engine fuel supply and control lines and relatively fragile instruments which are associated therewith an improved degree of protection against operational disruptions such as may be caused by the effects of severe shock loads thereon.

BRIEF SUMMARY OF THE INVENTION

The invention is illustrated herein as employing by way of this example a plurality of spaced apart all-directionally resilient vibration/shock isolating devices based between the ship's hull structure and a platform upon which is fixedly mounted an engine and its associated gearbox unit for driving the ship's propeller. In between the spaced apart resilient support devices, but normally in vertically spaced relation below the platform, there are disposed crushably or plastically deformable under compression "back-up" blocks such as may be formed for example of honeycomb structured plastic or metallic material or the like. The resilient supporting components of the system are so provided as to normally support the weight of the engine-gearbox sled unit and to mildly restrain it against motion in any direction relative to the hull, while permitting minor movements thereof in response to ship operating typically encountered vibrations. More particularly, in accord with the objects of the present invention, the resilient mounting components of the system are to be designed in each case so as to be of a stiffness as low as possible in order to minimize the magnitudes of underwater vibration and acoustic signatures of the ship such as when it is involved in surveillance operations or the like. The back-up blocks are dimensioned so as to be out of contact with the platform whenever the latter is stationary and/or shifting slightly relative to the hull in response to modest vibrations and/or shocks such as are incurred under normal ship operating conditions.

However, in response to more severe nearby mine explosion vertically directed shock loadings or the like, the platform will move into contact against the back-up blocks which are thereupon non-resiliently compacted while assisting in absorbing the higher energy segments of the shock forces. The resilient components of the system then operate to slowly restore the platform to its original position relative to the hull while the deformed back-up blocks contribute no rebound forces to the return operation. Incidentally, the resilient components are thus free to provide proper centering forces during the return operation without interference by the crushable components. Thus, the shock wave is dampened and accommodated in an improved manner, providing important protection against damage such as to the more delicate engine instruments and auxiliary components interconnected with the engine fuel supply and control lines and the like; as well as to the structure per se of the ship's hull.

The engine/gearbox mounting sleds and the combination resilient and crushable block vibration/shock isolating system are uniquely configured so as to incline the associated engine/gearbox units into directional alignment with the ship's propeller drive shafts. Also, it is to be noted that this relative arrangement of essential components of the system requires a minimum size envelope, thereby providing for ample headroom and space for personnel access to the engine/gearbox units for maintenance purposes.

DETAILED DESCRIPTION

Figure 1:
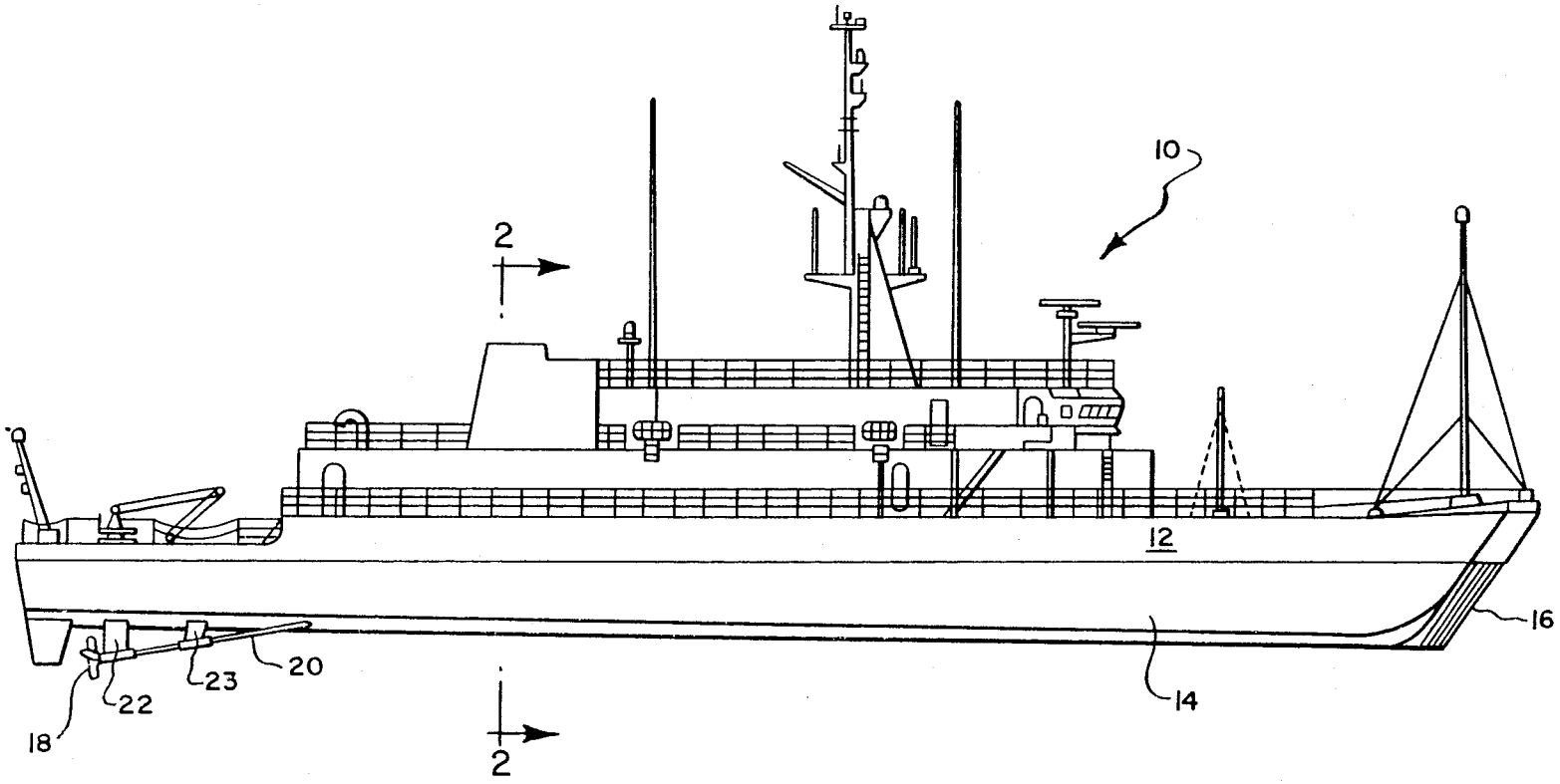
FIG. 1 is a side elevational view of an SES vessel of the type for which the shock absorbing engine and gearbox mounting system of the present invention is designed.
Figure 2:
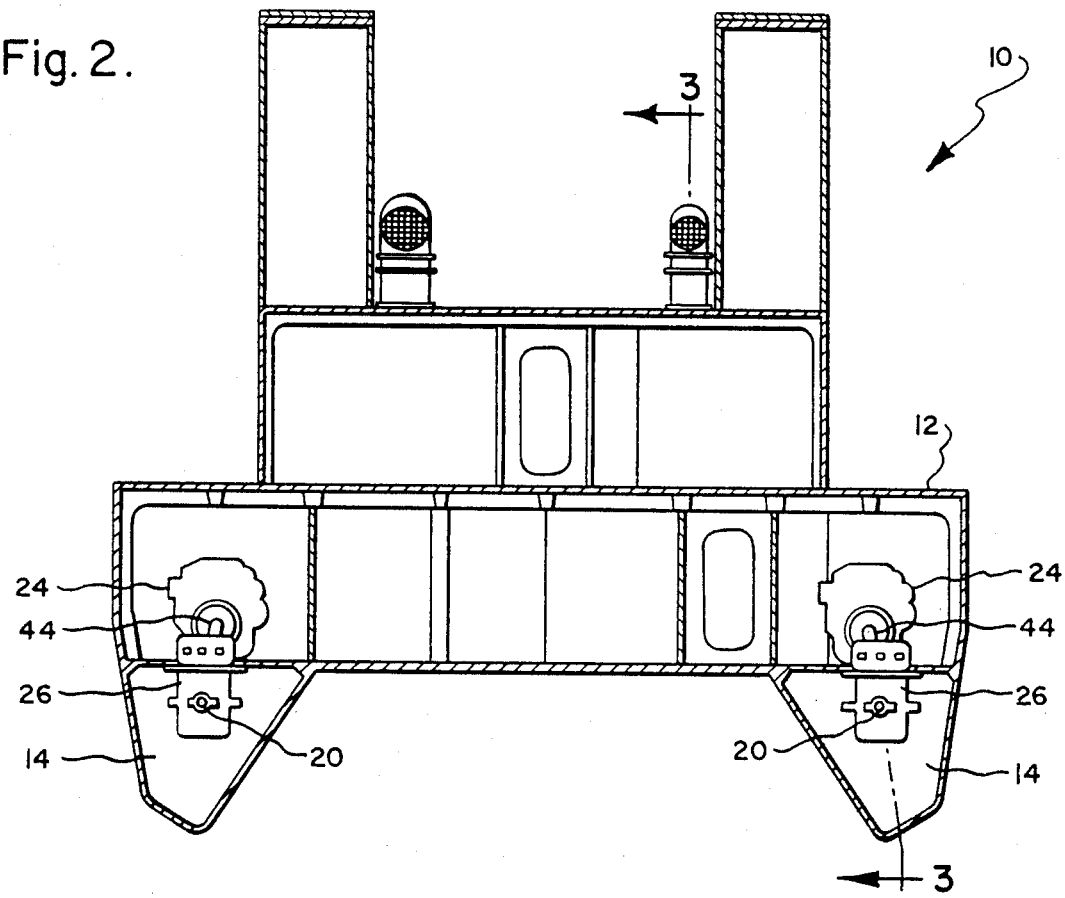
FIG. 2 is a sectional view on enlarged scale taken as along line 2—2 of FIG. 1.

The invention is illustrated in the drawing herewith as being embodied in a surface effect type ship designated generally by the numeral 10. The main hull of the ship is designated by the numeral 12 and is subtended below its opposite sides by means of sub hulls 14. As is typical, the space between the side hulls 14-14 at the bow end of the ship is traversed by a flexible seal system 16, and at its stern end by another suitable stern seal system (not shown) as is conventional in the art. The ship driving propellers are shown at 18 at opposite sides of the stern of the ship, and are carried by corresponding drive shafts 20-20 which are rotatably supported relative to the hull 14 such as by struts 22,23 (FIG. 1). In this case, the drive shafts 20 are illustrated to be separately driven by means of diesel engines or the like as shown at 24,24. The engines 24 drive the propeller shafts 20 by way of reversible direction and speed reducing gearbox units 26.

In accordance with the present invention, each engine 24 and its associated gearbox is based as a unit upon a rigid sled-like structure 28, which in turn is based upon the shock absorbing/damping support system of the present invention which is designated generally by the numeral 30. The system 30 comprises a plurality of isotropic spring devices such as for example are of the coil spring type as shown at 32 located below the peripheral edges of the sled 28, which in turn are based upon a rigid support structural portion 34 of the main and sub hulls of the vessel.

Figure 6:
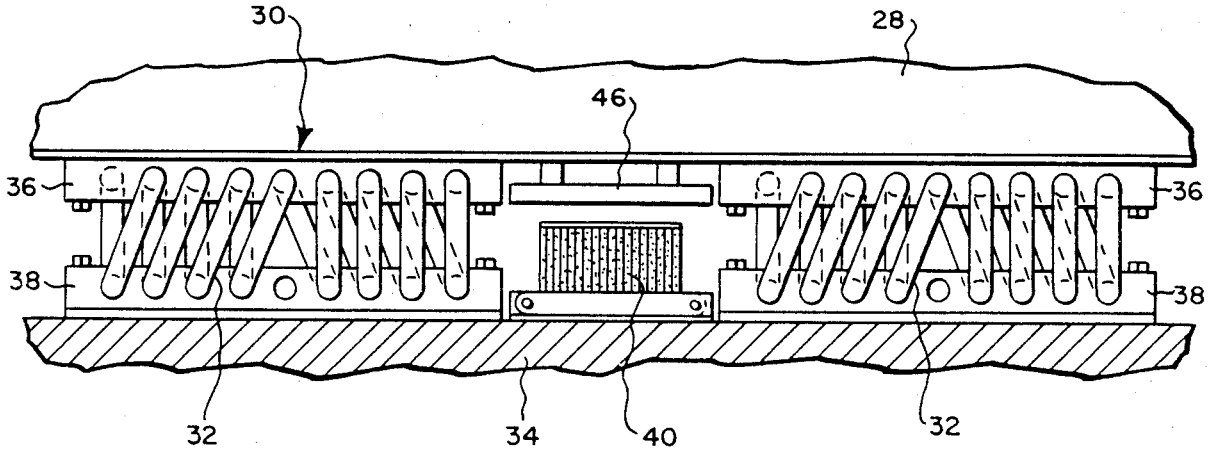
FIG. 6 is an enlarged scale fragmentary view of that encircled portion of FIG. 5 identified by the numeral 6.

As best shown at FIG. 6, the coil springs 32 may be carried by brackets 36,38, and in between separate spring units 32 there are disposed crushable or plastically deformable and substantially non-resilient load shock absorbing "back-up" blocks 40 such as may be formed of honeycomb plastic or metallic material or the like. Accordingly, it will be understood that upon encounters of normal ship vibration and/or externally imposed forces, the inertia of the engine/gearbox units will cause the structure of the support hull to shift slightly under the sleds while being restrained by the resilient components of the system. However, in event the shock is of sufficient intensity, the deformable blocks 40 will come into play to assist in restraining and limiting the extent of relative movement between the sleds and the hull. Upon termination of the shock effects, the resilient members then operate to relatively slowly restore the sled and engine/gearbox unit to its original position and centralized relative to the axis of the propeller drive shaft. This positional return movement occurs at a leisurely pace without assistance from the back-up blocks and therefore avoids damage to or disruption of the engine fuel supply and engine control line connections, or the like. As shown at 46 (FIG. 6), a vertically adjustable contact plate is preferably carried by each sled above each of the crushable blocks, whereby the system may be "fine-tuned" to provide for optimum performance of the shock absorbing units in accordance with operation of systems of the invention.

Figure 3:
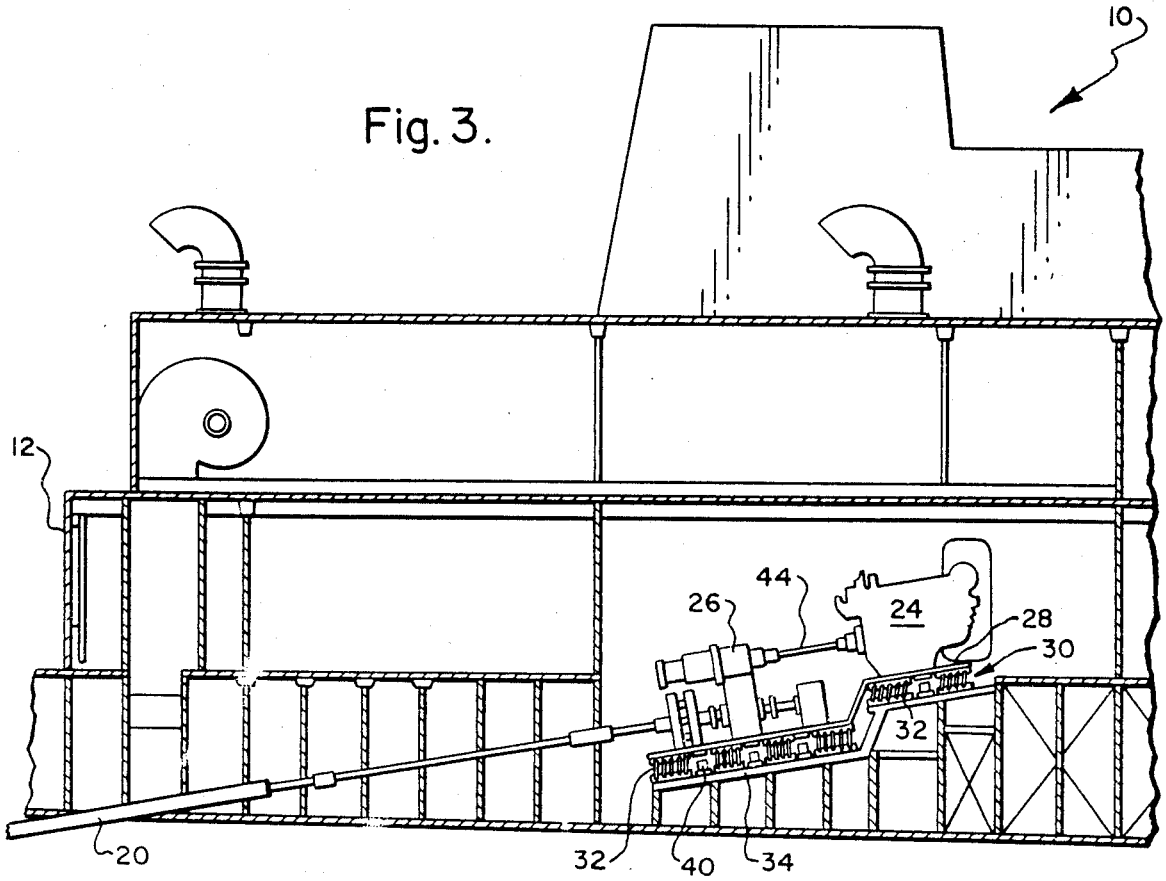
FIG. 3 is a sectional view taken as along line 3—3 of FIG. 2, illustrating the invention as being employed in conjunction with one form of engine/gearbox relative arrangement.
Figure 5:
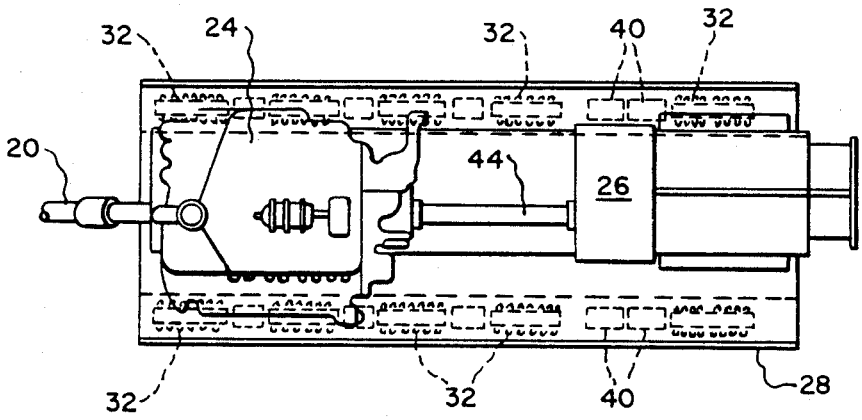
FIG. 5 is a plan view taken as along line 5—5 of FIG. 4.
Figure 4:
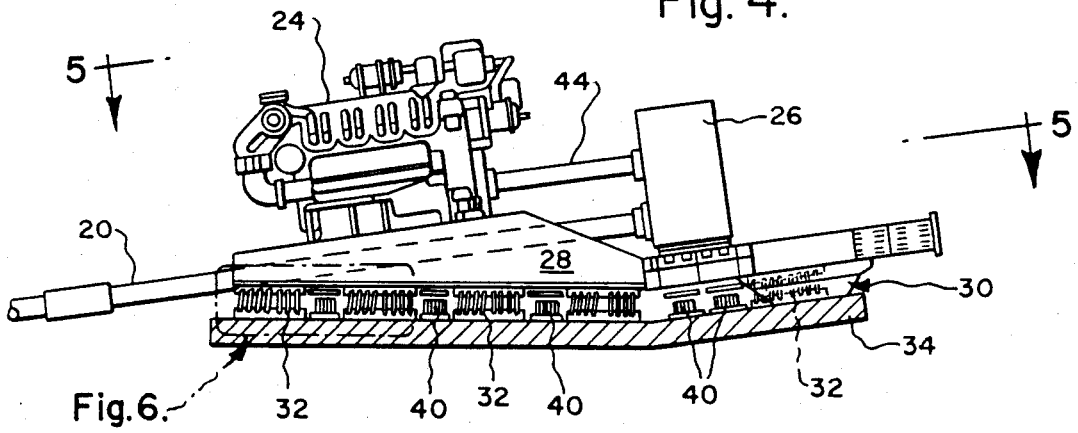
FIG. 4 is a fragmentary side elevational view corresponding to a portion of FIG. 3, but illustrates the invention as being embodied in an alternative arrangement of the engine per se in relation to the gearbox and drive shaft unit.

The unique design configurations of the engine/gearbox mounting sleds and shock absorbing systems, operate to position the inter-coupling drive shafts of the power train components and output shafts thereof in directionally mutual alignments with the ship's propeller drive shafts, whereby the necessity for employment of universal joints in the system is avoided. It is to be noted that in FIG. 3 and in FIGS. 4 and 5, the engine and gearbox units are shown in relatively reversed positions, but that in either case they are both rigidly based upon the sled. The preferred arrangement to be employed may in each case be selected in view of maintenance personnel working space requirements and/or other structural engineering considerations. Also, note that in the arrangement illustrated by FIG. 4, at least a portion of the sled is positioned in parallelism with the plane of inclination of the propeller drive shaft. This introduces angularly inconsistently directed forces into the spring units when the platforms move relative to the hull supporting structure, thereby further damping the reactions thereof to shock encountered by the ship.

What is claimed is:

1. A surface effect ship comprising in operative combination:

a main hull subtended along opposite sides thereof by side hulls;

ship driving power train means including engine means and directional and speed reducing gearbox units in operationally coupled relation carried rigidly upon a sled means which in turn is mounted upon shock absorbing means;

said shock absorbing means comprising all-directionally resilient spring units affixed to and sandwiched between said sled means and fixed structural members of said side hulls;

ship propeller drive shafts operationally coupled to said power train means and extending rearwardly and angularly downwardly therefrom through said side hull structures to protrude therebeyond;

ship driving propellers carried at the distal ends of said drive shafts; and structurally fracturable and dimensionally collapsible non-resilient compression resistant back-up means positioned in association with said resilient spring units and dimensioned so as to be normally out of contact with both of said sled means and said structural members but engageable and compressible therebetween upon relative displacements thereof exceeding those encountered during normal operations of said ship, so as to non-resiliently provide substantial assistance in retarding further displacements of said power train means beyond their normal positions relative to said side hulls.

2. A surface effect ship as set forth in claim 1 wherein said sled means comprise in plan view rectangularly shaped rigidly constructed platforms accommodating at opposite ends thereof said engine means and said gearbox means in vertically offset relationship.

3. A surface effect ship as set forth in claim 2 wherein said spring units and back-up means are arranged alternately in rows beneath opposite side edge portions of said platforms.

4. A surface effect ship as set forth in claim 3 wherein at least some portions of said platforms lie in planes parallel to said propeller drive shafts whereby to introduce angularly intersecting force components into said spring units upon displacements of said platforms from their normal positions relative to said hull supporting structures.

5. A surface effect ship as set forth in claim 1 wherein relative displacement degree adjustable contact means are provided for fine-tuned operation of the shock absorbing system.

6. A marine surface ship comprising in operative combination:

a hull;

ship driving power train means including engine means and a directional and speed reducing gearbox unit in operationally coupled relation carried rigidly upon sled means mounted upon portions of iso-directionally resilient spring means which are also at other portions thereof affixed to a structural portion of said hull;

a ship propeller drive shaft operationally coupled to said power train means and extending rearwardly and angularly downwardly therefrom through said hull structure to protrude therebeyond;

a ship driving propeller carried at the distal end of said drive shaft;

said power train mounting sled means being configured so that at least some portion thereof is inclined in parallelism with said propeller drive shaft; and structurally fracturable and dimensionally collapsible non-resilient compression resistant back-up block means positioned between said sled means and said structural portion of said hull and dimensioned so as to be normally out of contact with both said sled means and said structural portion despite minor displacements thereof towards one another, but operable upon major relative displacements thereof in response to severe shock loadings on said ship so as to non-resiliently provide substantial assistance to the action of said spring means in retarding still further displacements of said power train means from its normal position relative to said hull structure.

7. A ship as set forth in claim 6 wherein said sled means comprise in plan view a rectangularly shaped rigidly constructed platform accommodating at opposite ends thereof said engine means and said gearbox means in vertically offset relationship.

8. A ship as set forth in claim 7 wherein said spring means comprise separate units arranged in rows beneath opposite side edge portions of said platform.

9. A ship as set forth in claim 6 wherein said back-up block means comprises a plurality of separate back-up blocks dispersed intermediately of separated portions of said spring units.

10. A ship as set forth in claim 9 wherein at least some portion of said sled means lies in a plane parallel to said propeller drive shaft whereby to introduce angularly intersecting force vectors into said spring units upon displacements of said sled means from its normal position relative to said hull supporting structure.

11. In a surface effect ship having a glass fibre main hull structure provided with side hull keels and means for supporting most of the weight of the ship by an air cushion confined under the main hull structure while only the side hull keels are slightly submerged;

a ship propeller driving engine/gearbox arrangement and a platform mounting said arrangement so as to form a sled unit;

resilient means interposed between said sled unit and said main hull structure and elevating the sled unit above the hull structure for minimizing the magnitudes of underwater vibration and acoustic signatures of the ship when it is involved in surveillance operations or the like so as normally to support the weight of the sled unit and mildly restrain it against motion in any direction relative to the hull structure; and crushable means interposed between said sled unit and said hull structure and normally out of contact with one of them for contact and non-resilient crushing by the other of them in response to vertically directed high energy shock loadings caused by severe mine explosions nearby the ship.

12. In a surface effect ship as defined in claim 11 wherein the crushable means comprises a honeycomb structure.

13. In a surface effect ship as defined in claim 12 wherein said resilient means comprises coil spring sets disposed between the sled unit and the hull structure with the axes of the spring sets generally parallel thereto.

14. In a surface ship as defined in claim 13 including brackets on said hull structure and said sled unit which nest diametrically opposite portions of said spring sets therewithin.

15. In a surface ship as defined in claim 14 wherein adjacent spring sets are disposed so that one half the coils on one side thereof are generally perpendicular to the sled unit and the hull structure while the remaining coils on that side are oblique thereto.

16. In a surface ship as defined in claim 15 wherein said one half of the coils are oblique on the opposite side and the remaining coils on such opposite side are generally perpendicular to the sled unit and the hull structure.

17. In a surface effect ship as defined in claim 16 wherein said crushable means comprises a honeycomb structure.

18. In a surface effect ship as defined in claim 11 wherein said ship propeller driving engine/gearbox arrangement includes a propeller shaft which is downwardly inclined and is provided with a propeller at its distal end;

said resilient means comprising coil spring sets, at least some of which have their axes inclined with said propeller shaft.

* * * * *